United States Patent [19]

Findlay et al.

[11] Patent Number: 4,984,912

[45] Date of Patent: Jan. 15, 1991

[54] MULTICOLORED FABRIC PRINTING RIBBON INCLUDING NONBLEEDING, NONMIGRATING FLUSHED PIGMENT

[75] Inventors: Hugh T. Findlay, Lexington; Kenneth H. Froman, Versailles; James F. Martone, Lexington, all of Ky.

[73] Assignee: Internal Business Machine Corporation, Armonk, N.Y.

[21] Appl. No.: 512,630

[22] Filed: Apr. 19, 1990

Related U.S. Application Data

[63] Continuation of Ser. No. 229,194, Aug. 8, 1988.

[51] Int. Cl.[5] ..... B41J 31/00

[52] U.S. Cl. ..... 400/240.2; 400/241.3; 400/240

[58] Field of Search ..... 400/240, 240.1, 240 A, 400/241; 73/56; 106/23, 24; 524/270, 601; 428/323, 913, 914

[56] References Cited

U.S. PATENT DOCUMENTS

| | | | |
|---|---|---|---|
| 385,391 | 7/1888 | Underwood et al. | 400/240.2 |
| 2,590,200 | 3/1952 | Neidich | 400/240.2 |
| 4,116,924 | 9/1978 | Peabody | 524/270 |
| 4,400,216 | 8/1983 | Arora | 106/23 |
| 4,543,380 | 9/1985 | Schneider et al. | 524/601 X |
| 4,574,623 | 3/1986 | Neumann | 73/56 |
| 4,680,057 | 7/1987 | Hays | 106/23 |
| 4,724,002 | 2/1988 | Shibata et al. | 106/23 X |

FOREIGN PATENT DOCUMENTS

| | | | |
|---|---|---|---|
| 885813 | 12/1961 | United Kingdom | 400/240.2 |

*Primary Examiner*—David A. Wiecking
*Assistant Examiner*—Joseph R. Keating
*Attorney, Agent, or Firm*—John A. Brady

[57] ABSTRACT

A fabric ribbon having multicolored regions has coloring matter in the regions of only flushed pigments in a liquid vehicle. Flushed pigments do not migrate between colored regions under normal conditions, and therefore mixing of the colors is avoided without alteration of the fabric or use of a fabric with special characteristics or regions.

Flushed pigments have very small article size and perform like dyes with respect to replenishing the ribbon for good ribbon life. Yet, the ribbon colors do not bleed together, a characteriztic of pigments.

1 Claim, No Drawings

MULTICOLORED FABRIC PRINTING RIBBON INCLUDING NONBLEEDING, NONMIGRATING FLUSHED PIGMENT

This application is a continuation of 07/229,194 filed on Aug. 8th, 1988, now abandoned.

DESCRIPTION

1. Technical Field

This invention relates to fabric ribbons which are impacted by a print element to print more than one color. The print elements typically are fully formed character images on a daisy wheel or one or more columns of individual wires. Transferable colors are held in the fabric and expressed on to paper or other print-receiving medium by the pressure of printing. The colors are commonly located on the ribbon in strips which extend along the length of the ribbon or in blocks of one color alternating with blocks of another color along the length of the ribbon. Such ribbons become virtually useless if the colors blend together during storage or use.

2. Background Art

Prior to this invention, multicolored fabric ribbons were typically made using standard pigments as the coloring matter or dyes as part of the coloring matter with the different colors separated by some physical barrier or gap. The average particle size of standard pigments is nominally 4 to 5 microns, while dyes are molecular in size.

Inks with only standard pigments do not blend together in ordinary storage and use. This can be attributed to the fact that the pigment particles are relatively large in comparison with dye molecules, and ambient energy (which includes thermal, osmotic, capillary, Brownian, and other forces) is insufficient to move such pigment particles significantly. Different colored liquid inks with standard pigments only have been applied side-by-side on fabric ribbons without blending, but such ribbons do not replenish used areas well.

In contrast, dye molecules dissolved in a typical ink vehicle are so small as to be carried by the ink vehicle and to move when the ink vehicle is moved under the stresses of normal ambient heat, as well as other ambient forces. To control this movement, the ribbon has been designed in a way to block color movement. Commonly, the weave or continuity of the ribbon is physically interrupted at the boundary between colors, such as by adding an adhesive which is hardened or by crushing or melting the ribbon.

This invention completely avoids any change of the weave of the ribbon. In accordance with the instant invention, a particular coloring matter, specifically flushed pigments, are used (average nominally ½ to 1 micron, agglomerations up to 2 microns). These are pigments of very small particle size, but do not tend to mix even though the woven fabric of the ribbon is continuous at the boundary between inks of different colors. The very small particle size has been found to provide good ribbon life, the particles exhibiting sufficient limited mobility that colors reconstitute themselves sufficiently near locations from which impact printing has occurred.

U.S. Pat. No. 385,391 to Underwood et al has an embodiment shown in its FIG. 2 in which no difference in the ribbon at the boundary between colors is specified. The other embodiments of this patent show embodiments in which barriers to mixing of colors are created, by the manner the ribbon is woven or formed. Since the nature of the coloring matter in the FIG. 2 embodiment is only generally described, the use of flushed pigments is not suggested. U.S. Pat. No. 2,590,200 to Neidich teaches a ribbon in which the the fiber of the ribbon is predominantly in the direction of the boundaries of the different colors to prevent mixing across the colors.

Although flushed pigments are not widely used, flushed pigments are known and generally available, and flushed pigments have been used in woven ribbons. No use of flushed pigments in multicolored ribbons is known. U.S Pat. No. 4,574,623 to Neumann is cited merely as illustrative that flushed pigments are known.

U.K. Pat. No. 885,813, Titled "Improvements in or relating to Ink Ribbons," published Dec. 26, 1961, teaches a multicolored ribbon in which the weave of the ribbon is not modified to prevent mixing. Instead, the liquid vehicles of the inks are selected to be immiscible. In accordance with the instant invention the vehicles are not essential to preventing mixing and the vehicles for each color may be identical.

DISCLOSURE OF INVENTION

This instant invention is a fabric ribbon having multicolored regions of coloring matter in a liquid vehicle. The coloring matter of the regions is essentially only flushed pigments, which are pigments of particle size generally less than 2 microns and of average particle size of nominally ½ to 1 micron. (By contrast, standard pigments are nominally 4 to 5 microns in particle size.) Flushed pigments do not migrate between colored regions under normal conditions, and therefore mixing of the colors is avoided without alteration of the fabric or use of a fabric with special characteristics or regions.

The vehicles of the different colored regions are not significant in preventing migration, as the flushed pigments do not migrate with the vehicles. Nevertheless, the flushed pigments have sufficient mobility in regions from which ink has been depleted by printing to refill used areas of the ribbon with pigment, thus providing a ribbon of long useful life.

Colored strips having essentially only standard pigments do not tend to mix, but the ribbon life from ribbons having only such standard pigments is unsatisfactory because they do not replenish used areas well. Flushed pigments, being of very small particle size, do provide satisfactory life. Yet, no barrier is needed to prevent mixing between color regions. This invention also has the potential of preventing face-to-face mixing of the ribbon colors when the ribbon is in a stuffed chamber, which is a common cartridge design.

BEST MODE FOR CARRYING OUT THE INVENTION

Three subtractive colors of the preferred embodiment of this invention are as follows:

Subtractive Yellow

| Component | Percent by Weight |
|---|---|
| Flushed SICO Yellow MO 12 MO-1434 (Trademarked product of BASF Corporation) | 49.7% |
| Butoxy ethyl oleate (vehicle) | 44.7% |
| Castor oil (vehicle, increases | 5.6% |

-continued

| Component | Percent by Weight |
|---|---|
| viscosity) | |

The 12-MO-1434 is described by its supplier as 25% flushed yellow pigment and treated mineral oil as a vehicle. The approximate proportion of pigment to vehicle in the yellow ink therefore is 12.5% by weight pigment to 87.5% by weight vehicle.

Subtractive Red

| Component | Percent by Weight |
|---|---|
| Flushed LITHOL Rubine 45-MO-1998 (Trademarked product of BASF Corporation) | 53.7% |
| Butoxy ethyl oleate (vehicle) | 40.3% |
| Castor oil (vehicle, increases viscosity) | 6.0% |

The 45-MO-1998 is described by its supplier as 35% flushed red pigment and treated mineral oil as a vehicle. The approximate proportion of pigment to vehicle in the red ink is therefore 19% by weight pigment to 81% by weight vehicle.

Subtractive Blue

| Component | Percent by Weight |
|---|---|
| Flushed HELIOGEN Blue, MO 70-MO-2324 (Trademarked product of BASF Corporation) | 37% |
| Butoxy ethyl oleate (vehicle) | 56% |
| Castor oil (vehicle, increases viscosity) | 7% |

The 70-MO-2324 is described by its supplier as 37% flushed blue pigment, 58% vehicle solids, and treated mineral oil vehicle. The approximate proportion of pigment to vehicle in the blue ink is therefore 14% by weight pigment to 86% by weight vehicle and vehicle solids.

Each of the formulas is homogenized in a high speed mixer. The formulas are applied in any conventional manner, such as by a reverse roll coater, to adjoining regions of fabric. The fabric may be a conventional nylon woven fabric commonly used for impact printer ribbons. More specifically, in this preferred embodiment the fabric is highest quality filament nylon type 6,6; pH of 4.5–7, 4.0 mil (approximately 0.01016 cm) diameter; weight of 1.6 ounce per square yard (approximately 54.3 grams per square meter); warp (long direction) 174.0 threads per inch (approximately 68.5 threads per cm) and fill (cross direction) 114 threads per inch (approximately 45.7 threads per cm).

The details of the fabric are not considered limiting, and fabrics of other materials, such as cotton and other man-made polymers, are considered alternatives for use with this invention. The threads of the fabric may be woven, felted, or otherwise intermixed. However, if the interstices are exceptionally large, which would result from a very loose felting, for example, the boundaries between the colors would be uneven.

The fabric is entirely continuous and no change is made at the boundaries between the ink regions. The ink regions may be along the length of the ribbon, resulting in yellow, red, and blue strips side by side, each extending along the full length of a ribbon which typically is stuffed in the chamber of a ribbon cartridge or wound in a spool.

Mixing or blending of the ribbon colors is not experienced in normal use. The flushed pigments perform like dyes with respect to ribbon life, providing a ribbon which may be reused extensively, a characteristic of ribbons having dyes as the coloring matter. Yet, the ribbon colors do not bleed together, a characteristic of pigments.

Flushed pigments are understood to be made in a manner in which the pigments are never a dry solid. The resulting pigments are of much smaller particle size as compared to standard pigments. Agglomerations in flushed pigments may be as large as 2 microns, while the average particle size is nominally ½ to 1 micron. By comparison, the average particle size of standard pigments is nominally 4 to 5 microns. Alternative embodiments will be readily apparent from the foregoing discussion.

We claim:

1. A woven fabric impact ribbon comprising adjoining areas having a flowable ink of different colors in said areas each of said ink including a coloring matter and a liquid carrier said fabric ribbon having no change of weave and no physical color-separating barriers anywhere in the ribbon including at the adjoining areas between the different colors, the coloring matter of each of said areas not bleeding in normal use into another of said areas, and the coloring matter of each of said flowable inks consisting essentially of flushed pigments having an average particle size of between ½ and 1 micron and no more than 2 microns.

* * * * *